United States Patent [19]

Shinoda

[11] Patent Number: 4,554,634

[45] Date of Patent: Nov. 19, 1985

[54] ELECTRONICALLY CONTROLLED FUEL INJECTION SYSTEM

[75] Inventor: Kazuo Shinoda, Toyota, Japan

[73] Assignee: Toyota Jidosha Kabushiki Kaisha, Toyota, Japan

[21] Appl. No.: 474,322

[22] Filed: Mar. 11, 1983

[30] Foreign Application Priority Data

Apr. 2, 1982 [JP] Japan ..... 57-55624

[51] Int. Cl.[4] ..... F02M 39/00; F02M 51/00; F02D 5/02

[52] U.S. Cl. ..... 364/431.10; 123/446; 123/480; 364/431.07

[58] Field of Search ..... 364/431.07, 431.08, 364/431.10, 431.11, 431.12, 442; 123/339, 357, 445, 446

[56] References Cited

U.S. PATENT DOCUMENTS

| | | | |
|---|---|---|---|
| 3,643,635 | 2/1972 | Milam | 123/357 X |
| 3,981,288 | 9/1976 | Wessel | 123/455 X |
| 4,209,829 | 6/1980 | Leichle | 364/442 |
| 4,248,194 | 2/1981 | Drutchas et al. | 123/357 |
| 4,252,099 | 2/1981 | Kaiser | 123/446 |
| 4,423,485 | 12/1983 | Sami et al. | 123/446 X |

*Primary Examiner*—Felix D. Gruber

*Attorney, Agent, or Firm*—Cushman, Darby & Cushman

[57] ABSTRACT

In an electronically controlled fuel injection system for a gasoline engine, fuel flow by a fuel pump is controlled in accordance with different control variables for the engine, and reduction of fuel pump noise and power consumption is achieved without hindering or deteriorating engine operation conditions.

8 Claims, 6 Drawing Figures

ELECTRONICALLY CONTROLLED FUEL INJECTION SYSTEM

BACKGROUND OF THE INVENTION

1. Field of the Invention

The present invention relates to an electronically controlled fuel injection system, more particularly to an electronically controlled fuel injection system for a gasoline engine having a fuel system for supplying fuel to an injector and a control system for controlling the fuel injection time for the injector in which the fuel flow from an electric fuel pump is calculated in accordance with different control variables for the engine so as to reduce the noise of the fuel pump and to econimize or save the consumption rate of the electric power.

2. Description of the Prior Art

In conventional electronically controlled fuel injection system, when a key switch, for instance, is turned on, a battery voltage is always applied to the fuel pump and an engine begins operating with full power. However, in this kind of system according to the prior art, the following problems occur;

(a) the noise produced by the fuel pump becomes relatively conspicuous because of the low engine noise during idling of the engine, (b) electric power is wasted because the pump is always operated at full power in spite of the small fuel injection amount required by the engine, (c) the fuel in the fuel tank is heated as some of the fuel is always returned to the fuel tank operated at full power through the peripheries of the engine even if the fuel consumption amount or rate of the engine is small, and (d) the number of rotations of the fuel pump is decreased when the battery voltage is excessively lowered at the time of low temperature starting of the engine, and the engine start becomes difficult due to the resultant low fuel pressure.

SUMMARY OF THE INVENTION

It is a main object of the present invention to provide an electronically controlled fuel injection system having a fuel system for supplying fuel to an injector and a control system for controlling the fuel injection time of the injector in which the unit comprises a control circuit for controlling the fuel flow from the electrically operated fuel pump in the fuel system in accordance with control variables for the engine in the control system, whereby the noise produced in the fuel pump and the fuel consumption rate can be reduced while improvement of the engine starting and the lowering in the fuel temperature can be realized without hindering the engine operation conditions.

It is another object of the present invention to provide an electronically controlled fuel injection system wherein the engine noise can be suppressed to a low level during idling of the engine.

It is still another object of the present invention to provide an electronically controlled fuel injection unit wherein electric power necessary for driving the fuel pump can be reduced by a suitable determination of fuel flow for the engine operation.

DETAILED DESCRIPTION OF THE PREFERRED EMBODIMENT

Figure 1:
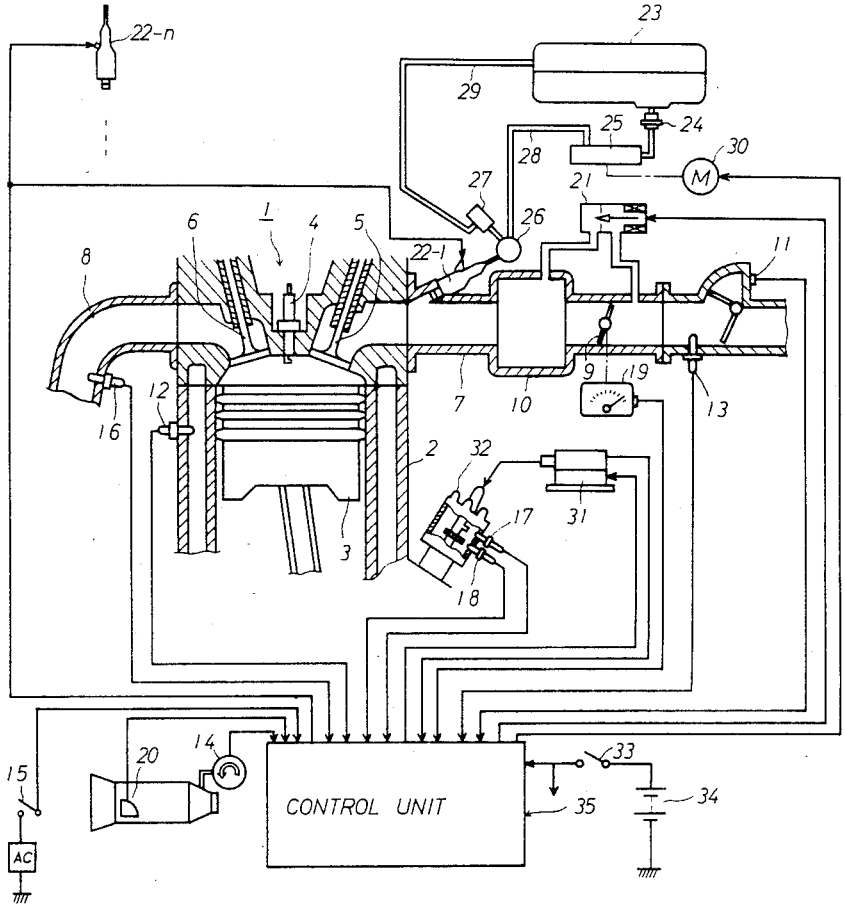
FIG. 1 is an overall construction of one embodiment of an electronically controlled fuel injection system in accordance with the present invention.

Referring to FIG. 1, the electronically controlled fuel injection system according to the present invention includes an engine body 1, a cylinder block 2, a piston 3, an ignition plug 4, an intake valve 5, an exhaust valve 6, an intake manifold 7, an exhaust manifold 8, a throttle valve 9, a surge tank 10, an air flow meter 11 for detecting air flow to the intake manifold 5, a water temperature sensor 12 for detecting the temperature of water, an intake air temperature sensor 13, a car speed sensor 14 for detecting actual car speed, an air conditioning switch 15 for an air conditioner of the car, an $O_2$ sensor 16 for detecting $O_2$, an air cylinder discriminating sensor 17, a rotational crank angle sensor 18, a throttle valve sensor 19 for detecting the throttle valve opening, a neutral switch or clutch switch 20, an idle speed control valve 21, each injector 22-i (i=1, 2, 3, . . . n) corresponding respectively to each of the n number of air cylinders, a fuel tank 23, a filter 24, a fuel pump 25 for supplying fuel for the engine, a delivery valve 26, a pressure regulator 27 for regulating the fuel pressure, a pressure line 28, a motor 30 for operating the fuel pump 25, an igniter 31, a distributor 32, a key switch 33, a power supply battery 34, and a control unit 35.

Figure 2:
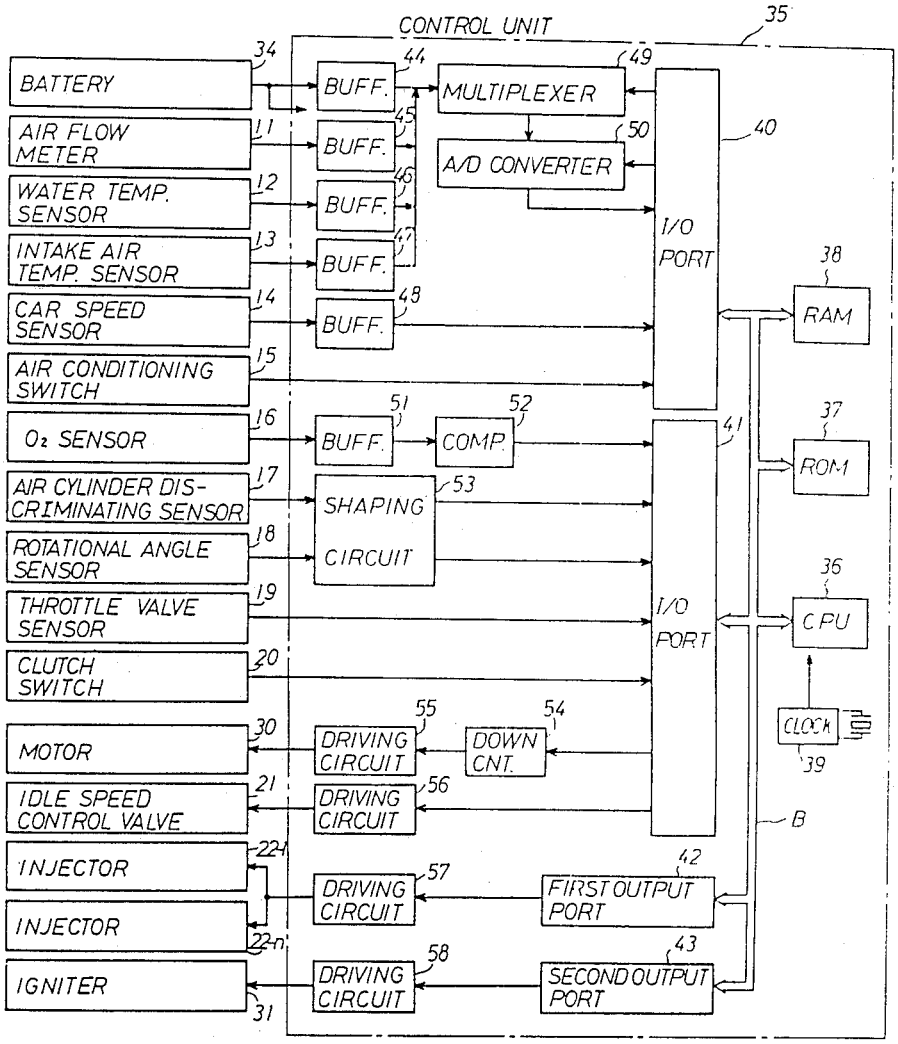
FIG. 2 is an electical block diagram of the control unit according to the present invention.

FIG. 2 illustrates the detailed construction of the control unit 35 shown in FIG. 1 which comprises a central processing unit (CPU) 36, a read only memory (ROM) 37, a random access memory (RAM) 38, a clock generator 39, a first input/output (I/O port) 40, a second input/output port 41, a first output port 42 and a second output port 43, and a bus B which connects there between. The control unit 35 further comprises buffers 44 through 48 and 51, a multiplexer 49, an A/D converter 50, a comparator 52, a wave shaping circuit 53, a down counter 54, and driving circuits 55 through 58.

The outputs of the battery 34, the air flow meter 11, the water temperature sensor 12, and the intake air temperature sensor 13 as shown in FIG. 1 are connected to the multiplexer 49 through each buffer 44 through 47, respectively. The multiplexer 49 selectively passes any one of the output signals from the battery 34, the air flow meter 11, the water temperature sensor 12, and the intake air temperature sensor 13 to the A/D converter 50 which converts each analog output signal from the multiplexer 49 into a digital signal in accordance with a control signal from the I/O port 40. The output of the car speed sensor 14 is connected to the I/O port 40 through the buffer 48, whereas the output of the air conditioner switch 15 is directly connected to the I/O port 40.

The output of $O_2$ sensor 16 is connected through the buffer 51 to the comparator 52 which compares the output signal transmitted from the $O_2$ sensor through the buffer 51 with a predetermined reference value. The output of the comparator 52 is applied to the I/O port 41. The outputs of the air cylinder discriminating sensor 17 and of the rotational crank angle sensor 18 are connected to the inputs of the wave shaping circuit 53 which shapes each signal from the air cylinder discriminating sensor 17 and the rotational crank angle sensor 18, and each output thus shaped is applied to the I/O port 41. The outputs of the throttle valve sensor 19 and of the neutral switch or clutch switch 20 are directly connected to the I/O port 41. The output of the I/O port 41 is connected to the down counter 54 in which duty ratio data from the I/O port 41 relating to the waveform for driving the motor 30 is set at every predetermined time period. The driving circuit 55 receives the output signal from the down counter 54 and outputs a corresponding driving signal to the motor 30. The output of the I/O port 41 is connected to the driving circuit 56 which drives the idle speed control valve 21 in accordance with a control signal output from the I/O port 41. The output of the output port 42 is connected to the first input of the driving circuit 57 which drives each injector 22-1 through 22-n in accordance with an injector control signal which is output from the output port 42. Similarly, the output of the second output port 43 is connected to the input of the driving circuit 58 which drives the igniter 31 in accordance with an igniter control signal outputted from the second output port 43.

The CPU 36 of the control unit 35 starts its operations or processing in accordance with a control program stored in advance in the ROM 37 in synchronization with the clock signal from the clock generator 39, when the voltage from the power supply battery 34 is supplied to the control unit 35 after the key switch 33 is turned on.

The operations or processing of the microprocessor mainly consist of an injection amount control, an ignition control, a fuel flow control, and an idle speed control valve control. Among the four operations or processings above, the injection amount control, for instance, is performed by outputting to each injector 22-1 through 22-n corresponding injector control signals after calculating the fuel injection time in the control unit 35 in accordance with each signal from the air flow meter 11, the water temperature sensor 12, the intake air temperature sensor 13, the car speed sensor 14, the air conditioner switch 15, the $O_2$ sensor 16, the air cylinder discriminating sensor 17, the rotational crank angle sensor 18, the throttle valve sensor 19 and the neutral switch or clutch switch 20.

Furthermore, the ignition control is performed by outputting to the igniter 31 the corresponding igniter control signal after calculating the ignition time and the conduction time thereof in the control unit 35 in accordance with each signal from the air flow meter 11, the water temperature sensor 12, the intake air temperature sensor 13, the air cylinder discriminating sensor 17, the rotational crank angle sensor 18, and the throttle valve sensor 19.

Figure 3:
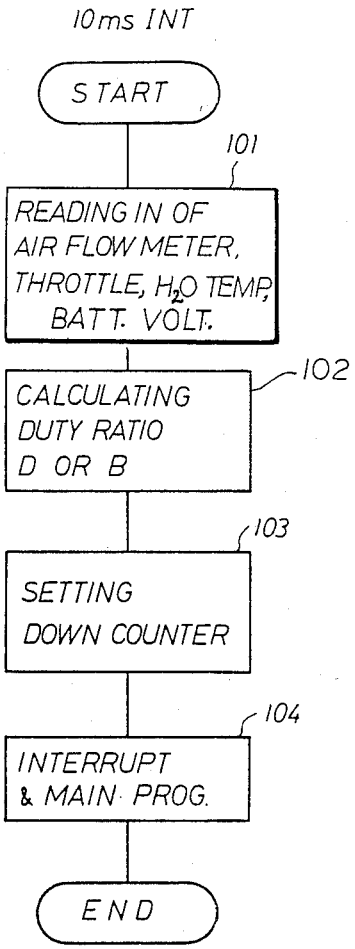
FIG. 3 is an operation flow chart for explaining a main operation of the control unit according to the present invention.

The fuel flow control operation which is the main feature in the embodiment according to the present invention will now be made with reference to the flow chart shown in FIG. 3.

Figure 4:
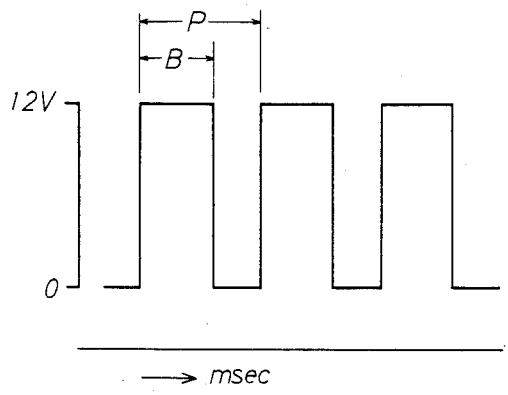
FIG. 4 is a waveform for driving a motor of the fuel pump.

The fuel pump control is performed by the execution of an interrupt routine of, for instance, 10 ms. Namely, in the step 101 shown in FIG. 3, intake air flow signal from the air flow meter 11, the water temperature signal from the water temperature sensor 12, and the voltage signal from the power supply battery 34 are read. Then, in the next step 102, the duty ratio D necessary for driving the motor 30 of the fuel pump 25 is calculated in accordance with signals mentioned above. The duty ratio D is calculated in accordance with the following equation;

$$D=(B/P)\times 100\%$$

where P and B indicate one period (e.g. 10 ms) of the motor driving waveform and the ON period thereof, respectively, as shown in FIG. 4.

Figure 5:
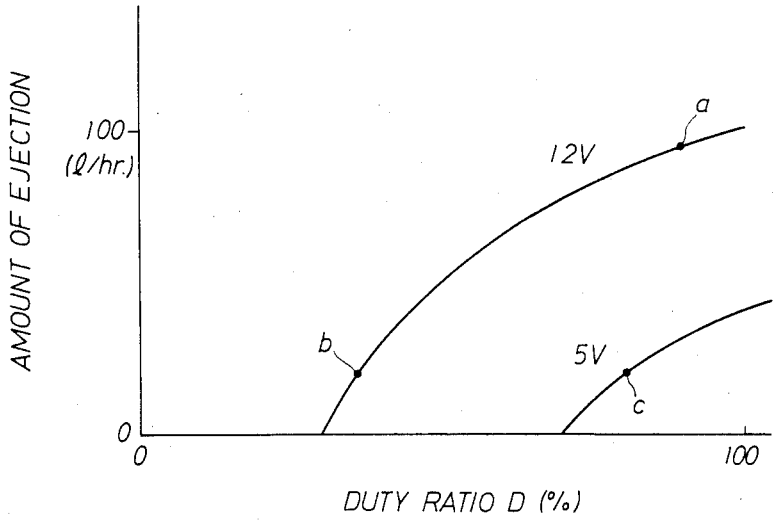
FIG. 5 is a graph showing characteristic curves between duty ratio and fuel ejection amount.
Figure 6:
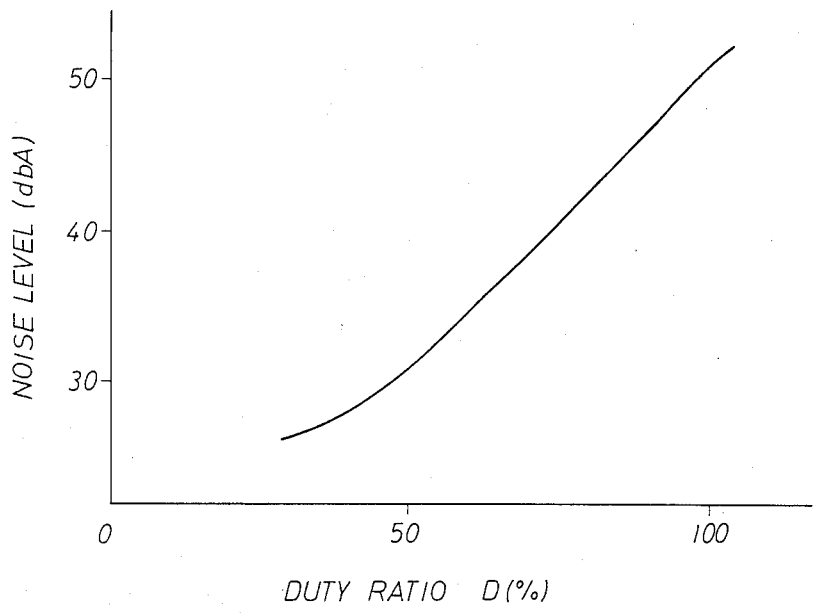
FIG. 6 is a graph showing a characteristic curve between the duty ratio and noise level of the engine.

The ON period may be calculated instead of calculating the duty ratio D. However, in this case, when calculating the duty ratio D or the ON period B, the characteristics of the ejection amount as shown in FIG. 5 can be used. For instance, when the power supply voltage is 12 V and the engine is operated in a high load condition, the duty ratio D must be determined relatively large such as 90% so as to obtain a relatively large amount of ejection as shown at the point a in FIG. 5, whereas when the fuel consumption amount of the engine is small as shown at the point b, the duty ratio D must be determined small such as 35% so as to obtain relatively small ejection amount. Moreover, when starting the engine in a low temperature with the power supply voltage being low, such as 5 V, the duty ratio should be determined at a relatively large value such as 80% so as to secure a predetermined ejection amount.

After calculating the duty ratio D or the ON period B as described in the foregoing, the next step 103 is executed. Namely, in this step, a certain value corresponding to the duty ratio D or the ON period B is set in the down counter 54 and the operation now moves to the next step. In the step 104, an interrupt operation is performed and now the operation shifts to the main program.

The down counter in which the value corresponding to the duty ratio D or the ON period B is set performs a subtraction operation or count down in synchronization with the clock signals from the clock generator 39. The down counter 54 is constructed in such a manner that the output signal thereof is at a high level before the content of the counter 54 becomes "0" and after reaching "0", it becomes a low level. The rectangular wave shape for driving the motor, shown in FIG. 4, indicates this condition.

As described in the foregoing, a suitable fuel ejection amount according to the operating condition of the engine is determined in accordance with the different signals or variables from the engine control elements such as the air flow meter 11, the power supply battery 34, etc. Accordingly, with respect to the noise of the engine, the more the duty ratio D is made small, the more the noise level can be reduced. For instance, when the engine is operated in a high power condition, the duty ratio is set to 100% in order to obtain sufficient fuel flow so that the noise level of the engine in this condition becomes relatively high such as 51 dbA. However, when the engine is in the idling condition, it is desirable for the noise level of the fuel pump to be suppressed at a relatively low level due to the lowering of the engine noise level, and hence the duty ratio must be determined small. For instance, when setting the duty ratio at 35%, the noise level becomes sufficiently low, such as 20 dbA.

As another embodiment of the fuel flow control system according to the present invention, an approximate fuel consumption rate or amount can be calculated from an input period of the ignition acknowledgement signal from the igniter, i.e. the number of engine rotations and the duty ratio D may be calculated from the fuel consumption amount thus calculated. In this case, when the number of engine rotations is low, the duty ratio D is made small and the number of rotations of the fuel pump 25 is also made small, whereas when the number of engine rotations is high, the duty ratio D is made large and the fuel pump 25 is rotated at high speed.

As still another embodiment of the fuel flow control system according to the present invention, the fuel injection amount is calculated from the fuel injection time and the number of engine rotations calculated in the injection amount control operation, and in turn the duty ratio D may be calculated.

Moreover, as a method of producing the motor driving signal, the following approach is possible; the ON timing and OFF timing can be controlled by measuring the on time of the CPU 36 in lieu of the down counter 54.

With respect to the idle speed control, the number of set rotations of the engine in the idling condition of the engine is to be maintained in accordance with each output signal from the sensors and switches such as, for instance, the water temperature sensor 12, the intake air temperature sensor 13, the car speed sensor 14, the air conditioner switch 15, the $O_2$ sensor 16, the rotational crank angle sensor 18, the throttle valve sensor 19, and the neutral switch 20.

As described in the foregoing, in the electronically controlled fuel injection system for a gasoline engine having a fuel system for supplying the fuel to the injector and a control system for controlling the fuel injection time of the injector, according to the present invention, a control unit is provided which controls the fuel flow from the electrically driven fuel pump in the fuel system in accordance with the engine control variables in the control system.

With this construction, according to the present invention, since the fuel flow suitable for the engine operation can be determined, the noise of the fuel pump during engine idling can be suppressed, while the electric power from the power supply battery dissipated in driving the fuel pump can be reduced.

While the invention has been described in its preferred embodiments, it is to be understood that the words which have been used are words of description rather than limitation and that various changes may be made within the purview of the appended claims without departing from the true scope and spirit of the invention in its broader aspects.

What is claimed is:

1. An electrically controlled fuel injection system for an engine, comprising:

a controlled injector to inject fuel into the engine;

controllable fuel pump means for sending pressurized fuel to said injector;

motor means for controlling said fuel pump means;

control circuit means for outputting pulse signals to said motor indicative of duration of fuel injection corresponding to operative conditions of the engine;

detecting means for detecting engine load;

sensing means for sensing on-condition of the engine; and means, responsive to said detecting and sensing means, for decreasing the duty ratio of said pulse signals output from said control circuit means to said motor means in accordance with decreasing engine load detected by said detecting means and for selectively increasing said duty ratio in accordance with the sensed condition of the engine sensed by said sensing means, thereby reducing fuel pump means operation noise and power consumption during low engine load conditions while providing adequate engine performance.

2. An electronically controlled fuel injection system as in claim 1, wherein said detecting means comprises an air flow meter.

3. An electronically controlled fuel injection system as in claim 1, wherein said sensing means comprises one of (A) means for detecting voltage of a supply source and (B) means for detecting temperature of engine cooling water.

4. An injection system as in claim 3, wherein said means for selectively increasing said duty ratio increases said duty ratio to a relatively large value whenever said sensing means detects a relatively low voltage from said supply source, thereby indicating a condition of engine starting in low temperature.

5. An electronically controlled fuel injection system as in claim 1, wherein said detecting means comprises a throttle sensor so that said duty ratio is decreased whenever engine idling is detected.

6. An electronically controlled fuel injection system as in claim 1, wherein said pulse signals of said control circuit means are generated with a down counter.

7. An electronically controlled fuel injection system, comprising:

an injector in a suction system of an engine;

fuel pump means for sending fuel to said injector under pressure;

motor means for activating said fuel pump;

control circuit means for outputting pulse signals to said motor means indicative of duration of fuel injection corresponding to operative conditions of an engine to thereby control activation of said motor means;

detecting means for detecting engine speed; and means, responsive to said detecting means, for decreasing the duty ratio of said pulse signals when said engine speed is relatively low and increasing said duty ratio of said pulse signals when said engine speed is relatively high, thereby reducing noise and power consumption of overall fuel pump means operation by reducing such operation during detected relatively low engine operating speeds.

8. An injection system as in claim 7, wherein said means for increasing said duty ratio increases said duty ratio to a relatively large value whenever the engine is being started during low temperatures.

* * * * *